US012422208B2

(12) United States Patent
Williams

(10) Patent No.: US 12,422,208 B2
(45) Date of Patent: Sep. 23, 2025

(54) SINGLE-USE FIREARM AND PERSONAL DEFENSE SYSTEM WITH ELECTRONICALLY INTEGRATED TRACKING SYSTEM

(71) Applicant: Tracy Williams, Pleasant View, TN (US)

(72) Inventor: Tracy Williams, Pleasant View, TN (US)

( * ) Notice: Subject to any disclaimer, the term of this patent is extended or adjusted under 35 U.S.C. 154(b) by 0 days.

(21) Appl. No.: 18/389,202

(22) Filed: Nov. 13, 2023

(65) Prior Publication Data

US 2024/0230261 A1 Jul. 11, 2024

Related U.S. Application Data

(63) Continuation-in-part of application No. 18/205,092, filed on Jun. 2, 2023, now Pat. No. 11,852,431.

(60) Provisional application No. 63/437,572, filed on Jan. 6, 2023.

(51) Int. Cl.

| | |
|---|---|
| ***F41A 3/00*** | (2006.01) |
| ***F41A 17/06*** | (2006.01) |
| ***F41A 17/30*** | (2006.01) |
| ***F41A 17/38*** | (2006.01) |

(52) U.S. Cl.
CPC ..... *F41A 17/063* (2013.01); *F41A 17/30* (2013.01); *F41A 17/38* (2013.01)

(58) Field of Classification Search
CPC ..... F41C 3/00; F41C 7/00; F41C 9/00; F41A 3/00; F41A 17/14
See application file for complete search history.

(56) References Cited

U.S. PATENT DOCUMENTS

| | | | | |
|---|---|---|---|---|
| 11,402,167 | B1 * | 8/2022 | Kraft | F41A 9/70 |
| 2015/0168090 | A1 * | 6/2015 | Bitsack | F41A 17/44 42/70.01 |
| 2016/0040950 | A1 * | 2/2016 | Malcolm | F41A 17/46 42/69.01 |
| 2020/0333099 | A1 * | 10/2020 | Özenser | F41A 33/04 |

* cited by examiner

*Primary Examiner* — J. Woodrow Eldred
(74) *Attorney, Agent, or Firm* — Origins Law, LLC; Nicholas Spatola

(57) ABSTRACT

The invention disclosed herein provides a system and a method for a single-use firearm and personal defense system, with an imbedded electronic device for tracking and control of the firearm. The system includes a single-use firearm capable of firing a projectile. The single-use firearm capable of firing a projectile comprises a firearm frame, at least a first barrel, a trigger operable to actuate a striking of at least a first ammunition cartridge, and an ammunition locking system, wherein the ammunition locking system permanently locks the at least first ammunition cartridge within the firearm, whereby once locked, the at least a first ammunition cartridge may not be removed or reloaded without permanently damaging the firearm. The system also incorporates internal electronics for, among other things, tracking, notifying, and monitoring the firearm and its users.

4 Claims, 15 Drawing Sheets

SINGLE-USE FIREARM AND PERSONAL DEFENSE SYSTEM WITH ELECTRONICALLY INTEGRATED TRACKING SYSTEM

CROSS-REFERENCE TO RELATED APPLICATIONS

This application is a continuation-in-part of co-pending U.S. patent application Ser. No. 18/205,092, filed Jun. 2, 2023, and entitled "Single-Use Firearm and Personal Defense System", which claims priority under 35 U.S.C. § 119(e) of U.S. Provisional Patent Application Ser. No. 63/437,572, filed Jan. 31, 2023, and entitled "Single Use Firearm and Personal Defense System", which is hereby incorporated by reference.

FIELD OF THE INVENTION

The present invention relates to limited capacity and single-use firearms.

BACKGROUND

Firearms are widely used for personal defense, law enforcement, and recreational purposes. Traditional firearms typically consist of a firearm frame, a barrel, a trigger mechanism, and an ammunition loading system. These firearms allow users to load and unload ammunition cartridges as needed. However, this unrestricted access to the ammunition loading system poses potential risks, such as accidental discharge, unauthorized use, or tampering.

Various attempts have been made to address these safety concerns and prevent unauthorized access to firearms. For instance, some firearms incorporate mechanical or electronic locking mechanisms to restrict firing until an authorized user enters the correct code, passes a biometric test, or uses a specific key. While these mechanisms provide a level of security, they may still allow the removal or reloading of ammunition cartridges, presenting opportunities for misuse or tampering.

Other designs have focused on providing multiple barrels or chambers within a single firearm to allow the user to fire several cartridges of ammunition sequentially. However, these designs still enable the user to reload or replace the ammunition cartridges, which may not be desirable in certain situations where the ammunition needs to be permanently fixed or where the firearm is intended for single-use purposes.

In addition, a firearm may be considered a major commitment for potential purchasers. Not only is there a financial commitment to purchasing ammunition for purposes of practicing, owning a firearm creates a duty to secure the firearm safely, always know where the firearm is, and avoid the potential for others to misuse or misappropriate its possession.

This has led many people to avoid firearms altogether. Others are deterred from ownership because of the presence of gun violence. However, some may choose ownership if there was a specific set of protocols that made misuse of the firearm difficult and made control and monitoring of the possession of the firearm easy.

Systems that could disable a firearm based on location, systems that could limit the amount of uses the firearm is capable of, and systems that could notify the user if any misuse occurs may open ownership of firearms to more individuals seeking firearm possession for use in only a select number of scenarios, while preventing inappropriate use.

Thus, a need exists in the market for a firearm and personal defense system that bridges the gap in the market between non-ownership and full firearm ownership that is capable of solving the above issues, prevents firearm misuse, and provides a firearm that combines enhanced safety features with a single-use design, wherein the ammunition cartridges are permanently locked within the firearm and cannot be removed or reloaded without causing irreversible damage to the firearm.

SUMMARY OF THE INVENTION

The invention disclosed herein provides a single-use firearm capable of firing a projectile. The single-use firearm capable of firing a projectile comprises a firearm frame, at least a first barrel, a trigger operable to actuate a striking of at least a first ammunition cartridge, and an ammunition locking system, wherein the ammunition locking system permanently locks the at least first ammunition cartridge within the firearm, whereby once locked, the at least a first ammunition cartridge may not be removed or reloaded without permanently damaging the firearm.

The invention disclosed herein also provides an embedded electronic device for tracking and operation. The electronic system is configured within said firearm frame having at least a communication module, a geolocation module, at least one camera with microphone, a control module of an internal circuitry with a processor, a battery, a means for disabling said firearm, and a memory with a program stored thereon that, when executed by said processor of said control module performs the steps of: booting up the electronic system within the firearm, querying the status of the firearm, querying if the firearm is in its base station, querying the status of a primary battery of the firearm, querying the status of a secondary battery of the firearm, querying the status of a wireless local area network (WLAN) connection, querying the status of a short-range wireless communication protocol connection, querying the status of a cellular connection, querying the status of a Global Positioning System (GPS) module and current GPS location, querying whether the firearm is within a pre-defined geofence location, disabling the firearm if the firearm is not within a predefined geofence location and reporting an overall status of the electronic system to a server, reporting an overall status of the electronic system to a server if the firearm is within a predefined geofence location, detecting whether the firearm is removed from its base station, sending a notification to a user's smart home alarm system if the firearm is removed from its base station, sending a notification to a remote monitoring station if the firearm is removed from its base station, querying whether the firearm is within a pre-defined geofence location, disabling the firearm if the firearm is not within a predefined geofence location and reporting an overall status of the electronic system to a server, querying whether a pull-pin-style safety mechanism has been removed, notifying emergency services if the pull-pin-style safety mechanism has been removed, initiating video and audio recording if the pull-pin-style safety mechanism has been removed, querying whether the firearm has been fired, and notifying emergency services if the firearm has been fired.

The invention disclosed herein also provides a method for personal defense implementing a single-use firearm capable of firing a projectile. The method comprises steps of providing a firearm frame, providing at least a first barrel, providing a trigger operable to actuate a striking of at least a first ammunition cartridge, and providing an ammunition locking system, wherein the ammunition locking system permanently locks the at least first ammunition cartridge within the firearm, whereby once locked, the at least a first ammunition cartridge may not be removed or reloaded without permanently damaging the firearm.

The method disclosed herein also includes providing an embedded electronic device for tracking and operation. The electronic system is configured within said firearm frame having at least a communication module, a geolocation module, at least one camera with microphone, a control module of an internal circuitry with a processor, a battery, a means for disabling said firearm, and a memory with a program stored thereon that, when executed by said processor of said control module performs the steps of: booting up the electronic system within the firearm, querying the status of the firearm, querying if the firearm is in its base station, querying the status of a primary battery of the firearm, querying the status of a secondary battery of the firearm, querying the status of a wireless local area network (WLAN) connection, querying the status of a short-range wireless communication protocol connection, querying the status of a cellular connection, querying the status of a GPS module and current GPS location, querying whether the firearm is within a pre-defined geofence location, disabling the firearm if the firearm is not within a predefined geofence location and reporting an overall status of the electronic system to a server, reporting an overall status of the electronic system to a server if the firearm is within a predefined geofence location, detecting whether the firearm is removed from its base station, sending a notification to a user's smart home alarm system if the firearm is removed from its base station, sending a notification to a remote monitoring station if the firearm is removed from its base station, querying whether the firearm is within a pre-defined geofence location, disabling the firearm if the firearm is not within a predefined geofence location and reporting an overall status of the electronic system to a server, querying whether a pull-pin-style safety mechanism has been removed, notifying emergency services if the pull-pin-style safety mechanism has been removed, initiating video and audio recording if the pull-pin-style safety mechanism has been removed, querying whether the firearm has been fired, and notifying emergency services if the firearm has been fired.

It is an object of the invention disclosed herein to provides a single-use firearm having, capable of firing a pre-loaded quantity of ammunition, wherein once loaded, the ammunition cannot be removed. That is, once the ammunition is loaded and the barrel-housing component is locked into place, a permeant affixing means is implemented to prevent the removal of ammunition or reloading of ammunition without breaking the body components.

It is another object of the invention disclosed herein to provides a single-use firearm strong capable of using adhesives, snap locks, or a combination therewith, to render the firearm un-disassembleable.

It is another object of the invention to disclose a firearm containing an electronics system providing tracking and notification to a mobile software application, law enforcement, and monitoring services.

It another object of the present invention to provide a system that can be used to contain use of the firearm to predetermined areas.

It is yet another object of the present invention is to provide a firearm that is constructed of disposable and recyclable materials that are cost effective and can be reacquired by the manufacturer to refurbish, reuse, or recycle.

The drawings and specific descriptions of the drawings, as well as any specific or alternative embodiments discussed, are intended to be read in conjunction with the entirety of this disclosure. The invention may be embodied in many different forms and should not be construed as being limited to the embodiments set forth herein; rather, these embodiments are provided by way of illustration only and so that this disclosure will be thorough, complete, and fully convey understanding to those skilled in the art. The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
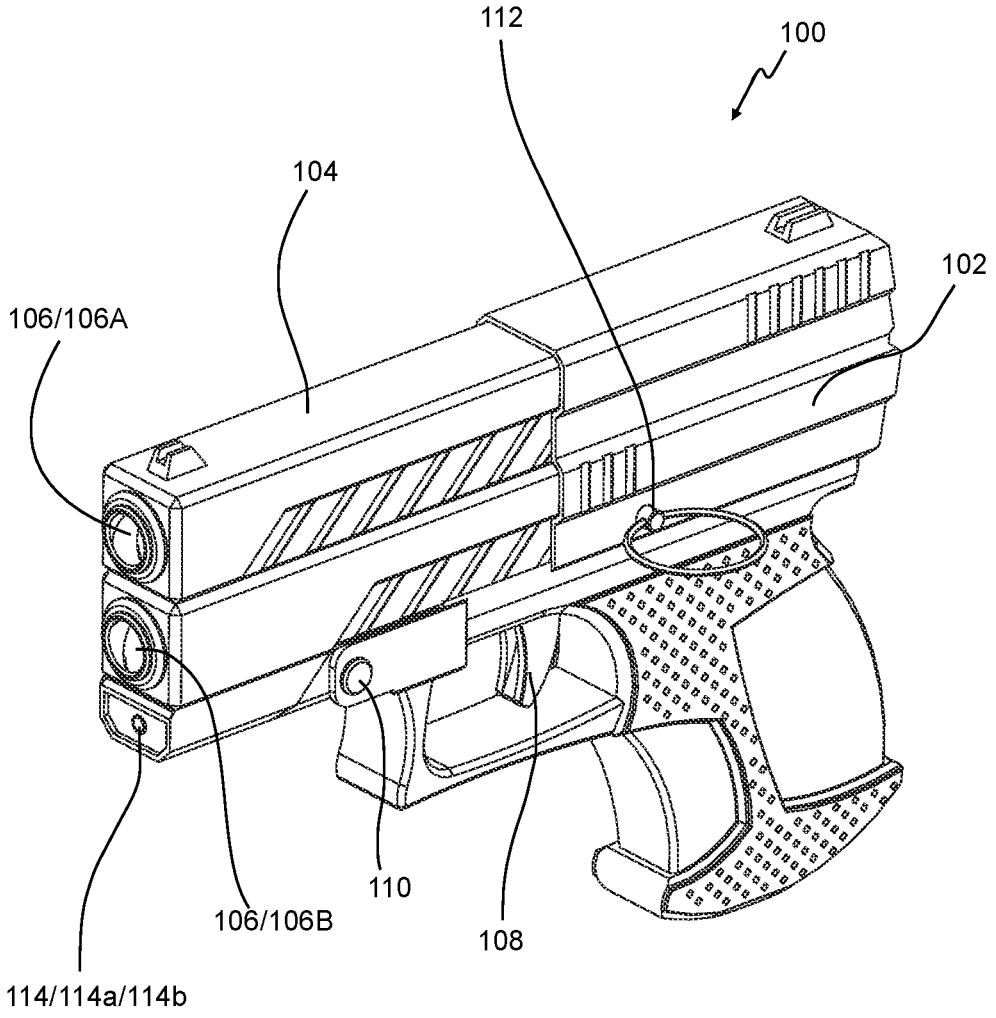
FIG. 1 illustrates a front isometric view of a single-use firearm.

The invention herein provides a solution for individuals who chose not to own a typical reloadable firearm, but still wish to defend themselves, others, and their homes. The invention includes a uniquely configured single-use multi-part firearm, permanently affixing, limited shot firearm capable of solving the above issues.

Current firearms are commonly used for personal defense, law enforcement, and recreational purposes. Traditional firearms typically consist of a frame, barrel, trigger mechanism, and ammunition loading system, allowing users to load and unload cartridges as needed. However, this continuous loading and unloading of ammunition may pose risks such as accidental discharge, unauthorized use, and tampering. Efforts have been made to address these safety concerns and prevent unauthorized access to firearms. Some firearms incorporate mechanical or electronic locking mechanisms that restrict firing until an authorized user enters a code or uses a specific key. While providing a certain level of security, these mechanisms still allow cartridge removal or reloading, creating opportunities for misuse or tampering. Other firearm designs feature multiple barrels or chambers, allowing sequential firing of several cartridges.

However, these designs still enable cartridge reloading, which may not be desirable in situations where permanent fixation is required or when the firearm is intended for single-use purposes. Furthermore, owning a firearm entails financial commitment and responsibility for its safe operation, secure storage, and prevention of unauthorized access. Some individuals may avoid firearms due to these factors or concerns about gun violence. However, if personal protocols were put in place by a user to make firearm misuse difficult and facilitate control and monitoring of firearm possession, some individuals may consider ownership for specific scenarios while preventing inappropriate use.

The invention herein provides a solution for individuals who chose not to own a typical reloadable firearm, but still wish to defend themselves, others, and their homes. The invention includes a uniquely configured single-use firearm capable of solving the above issues, and also providing a system capable of disabling a firearm based on location, limit its number of fires, and/or notify users of any misuse. This could expand firearm ownership to individuals seeking possession for select scenarios while preventing improper usage.

In some embodiments, the firearm may be constructed of plastic and disposed of after the firearm has been discharged. Disposal may include repossession of the firearm by the manufacturer for potential refurbishment or recycling. Other disposal options may include trade-in programs to ensure any internal components and batteries are fresh and functional.

The present invention applies a multifaceted approach to single-use home defense. The first element of this multifaceted approach is a firearm, as disclosed herein, capable of firing a projectile. The firearm is configured for single use, whereby ammunition is either incorporated into the manufacture of the firearm, as applicable by law, or ammunition is loaded in but is no longer removable once the firearm is assembled. In an ideal embodiment, the firearm will be capable of at least one or two shots.

One embodiment of configuration as a single use firearm may employ a two-part loading system, wherein ammunition is loaded into a barrel section, and then the barrel is snapped into a locking position onto the firearm frame. After it is snapped on, the barrel section cannot be removed by the user without damaging the firearm.

The single use firearm also incorporates a unique safety system, which requires disengagement of a safety mechanism to fire. In the disclosed embodiment, the safety mechanism is a pull-pin-style safety mechanism, similar to those on grenades and fire extinguishers. Once the pin is pulled, the firearm is live and capable of firing. In some embodiments, the system will also include a safety trigger lock, that must be depressed in order for the trigger to be pulled.

The second element of the multifaceted approach to single-use home defense is the electronics and communication system within the firearm. The firearm contains electronic components, including at least a memory for storing a program, a processor for executing the program, a transmitter and receiver capable of sending a signal from the firearm to a network connecting a remote monitoring station, a geolocation module capable of determining the location of the firearm, and a sensor for detecting a triggering event, such as pulling the pull-pin-style safety mechanism, or detection of a fired projectile.

These components help make up the broader system for home defense. When the pull-pin-style safety mechanism on the firearm is pulled, the firearm is live and capable of firing, though in some embodiments, a step of depressing a trigger lock is also required in order to fire. Once the pull-pin-style safety mechanism is pulled, the firearm begins transmitting information to a monitoring center so that police may be dispatched to the location. Some embodiments can notify both the police directly by calling 911 and a monitoring service. That is, if the firearm is fired, the firearm electronics notifies a service, calls 911, or both. The communications may be sent over cellular, wireless local area network (WLAN), or in some embodiments, transmitted over satellite connection. As used herein, wireless local area network refers to a communication protocol such as that conforming to the IEEE 802.11 standard. For convenience, the commonly recognized trade name "WiFi" may be used interchangeably in this disclosure to refer to this protocol.

Other events may trigger communications, including firing the firearm. If the firearm is fired, police may be notified to keep the communication open and disclosure of any meaningful escalations while enroute to the location of the firearm.

A mobile software application ("app") is also disclosed, whereby the app pairs with the firearm. While some communications from the firearm are intended to be sent to emergency services, as described above, these same notifications may also be sent to the app. These embodiments may also include a a short-range wireless communication protocol module on the firearm for communication. As used herein, short-range wireless communication protocol refers to a communication protocol such as that conforming to the IEEE 802.15.1 standard. For convenience, the commonly recognized trade name "Bluetooth" may be used interchangeably in this disclosure to refer to this protocol.

In addition to the above triggering events, moving the firearm may trigger a communication notification. Using the app, a user can set up notifications when the firearm is moved. Different modes, or a combination thereof, of achieving this may be implemented, including using geolocation and geofencing based on a cellular, satellite, or Bluetooth connection, or may be based on movement from a gyro sensor or accelerometer, to detect when a firearm has left a predetermined distance or location. This is of particular importance for those individuals who are concerned about the firearm being stolen, moved, or removed by others without knowledge. The app can be used to locate the firearm, such as for law enforcement purposes if the firearm has been improperly taken. The app may also confirm the state of the firearm, including battery level, in-use notification, unused status, or ready-to-use status. The app can be used to notify user if/when firearm has been armed/pin pulled or fired. The app can also be used to notify user that device has been moved outside of home area. App can also be used to "disarm" notifications from device. The purpose of this would be if you intend to move or relocate the firearm out of your home area for any purpose.

Further, in some embodiments, the firearm can have 2 cameras and microphones, one facing the person holding the firearm and one facing the direction the firearm is pointed. When the pull-pin-style safety mechanism is pulled, the firearm starts recording video and audio. The video and audio can be streamed to the service or law enforcement so that the proper authorities are aware of escalations in the matter.

In some embodiments, the geolocation services provide more operability than simple tracking operations. For example, if the firearm is moved outside a registered GPS area, the electronics will release an internal safety pin that renders the firearm unable to fire. In addition, because some individuals may choose to open or concealed carry the firearm, areas that are registered as gun-free zones may also temporarily disable the firearm. Further, the firearm can be purchased and registered to be at a location (for instance, at the end user's primary residence). If the firearm is moved outside of a set radius, the firearm calls the service. The end user can enable/disable tracking on the app service. For instance, when the user is going to carry the firearm, the user would disable tracking. The end user could also enable tracking along a specific route and timeframe. An end user could tag every firearm they own and on the service, they would be able to see the location of all firearms. Each firearm could be assigned its own home location.

The firearm electronics may have two power sources. The primary source provides continuous power and is kept charged by an external power source. The secondary power is backup power. In the case the firearm's primary power source is dead, when the safety pin is pulled, it connects the secondary power source to power the electronics, so it works right after the safety pin has been pulled. Further, some power components may be rechargeable.

Different electronic elements may be incorporated into the system as well, including laser assisted aiming, and dryfire training with systems that incorporate lasers and other emitters in combination with a sensor. Dryfire training systems may allow users to practice with this firearm while still maintaining the integrity of the single-use limitation. Because the trigger of the system can depress regularly while the pull-pin-style safety mechanism is in place without firing the firearm, a user can get the actual feel of pulling the trigger.

In some embodiments, because the firearm is manufactured of plastic, the barrel will not have rifling on it. Therefore, in order to ensure the invention is operable, custom bullets containing rifling on it may be provided, whereby the rifling on the bullet would cut into the plastic barrel and cause the bullet to rotate making the plastic firearm barrel more accurate. However, in many applications, the firearm will use a rifled steel barrel.

In some embodiments, a taser may also be incorporated to launch an electrified projectile as a non-lethal "warning" on a first trigger pull before the ammunition is engaged.

The trigger/firing pin details may include: i) 2 firing pins that are spring loaded, ii) pull-pin-style safety mechanism that prevents the slide plate from moving; iii) when pull-pin-style safety mechanism is pulled, one pull of the trigger slides the slide plate down so hole 1 lines up with ammunition, iv) pin springs forward and fires the gun, v) $2^{nd}$ pull of trigger, slides the slide plate down so hole 2 lines up with $2^{nd}$ ammunition, vi) pin springs forward and fires the gun, vii) slide plate may have slotted holes so slot holds back the pin and when it slides down, the slot opens up to let the pin loose.

Regarding the firearm software, the firearm software comprises of four software components. They are:

Monitoring Software inside the firearm;

Gateway Server;

Monitoring Service; and

Smart Phone Application.

Regarding the details of each are as follows:

Monitoring Software: the firearm has a microprocessor that monitors the status of the firearm and reports the firearm health back to the firearm gateway server. The firearm software checks the GPS coordinates of the firearm, whether the firearm is in the base station or not, the battery status, and the status of each of the three ways the firearm has to communicate to the server and service (WiFi, Bluetooth, and Cellular). The firearm's health is then reported on a regular basis to the firearm gateway server. The firearm software is also continuously monitoring that the firearm is within the geo-fenced coordinates specified as the location the firearm is to be located at, along with when the firearm is removed from the base station, when the safety pin is pulled, and when the firearm is fired. Any of these events triggers the firearm to take specific actions. These actions can be a local alarm, send data to the gateway server, notify the service, start recording video and audio, and call 911.

Gateway Server: the gateway server keeps all the data for every firearm in use. This data includes the firearm serial number, details of ownership, the registered location of the firearm, the size of the geo-fenced area the firearm is authorized to be used, and the health status of the firearm. The gateway server is continuously monitoring the status of every firearm in the system and reports to the service anytime an event occurs that triggers the service.

Firearm Monitoring Service: the monitoring service is the service used to take actions when triggered by certain events. For instance, when the firearm is removed from the base station, the service is notified, and a message and a call is placed to the firearm owner. If the safety pin is pulled, the service is notified and 911 is called. If the firearm is fired, the service is notified and 911 is called.

Firearm Smart Phone Application: the smart phone application is an application that is installed on the phone of the registered owner of the firearm. The application has the ability to provide notifications to the owner. The owner can also use the application to check the firearm status. The application provides the health of the firearm in a simple checklist that has the status shown in a simple green/red checkmark for each item. More details can be accessed by clicking on an item. For instance, if the firearm is in the base, the firearm in base line item will have a green check. If the primary battery is fully charged, the primary battery status will have a green check. If the primary battery is low, the primary battery will have a red checkmark. Any health item that is not healthy will generate a message to the owner.

It is to be appreciated that these components may be separated in some embodiments. For example, a single-use firearm may be produced without electronic components, and a retrofittable attachment may be rail-mounted to existing firearms for tracking purposes.

The single-use firearm and personal defense system of the present invention may be used to provide a single-use firearm having, capable of firing a pre-loaded quantity of ammunition, wherein once loaded, the ammunition cannot be removed. The single-use firearm and personal defense system of the present invention may also be used to provide a single-use firearm strong capable of using adhesives, snap locks, or a combination therewith, to render the firearm un-disassembleable. The single-use firearm and personal defense system of the present invention may also be used to provide a firearm containing an electronics system providing tracking and notification to a mobile software application, law enforcement, and monitoring services. The single-use firearm and personal defense system of the present invention may also be used to provide a system that can be used to contain use of the firearm to predetermined areas. The single-use firearm and personal defense system of the present invention may also be used to provide a firearm that is constructed of disposable and recyclable materials that are cost effective and can be reacquired by the manufacturer to refurbish, reuse, or recycle. This apparatus and system are particularly shown in FIGS. 1-11D.

FIG. 1 illustrates a front isometric view of a single-use firearm 100. The firearm 100 includes a frame body member 102 and barrel housing member 104. The frame includes a handle housing electronic components (as may be seen in FIG. 9). The barrel housing member 104 contains at least one barrel 106, but is shown to have two independent barrels 106 in the exemplary embodiment shown in FIG. 1. Also seen in FIG. 1 are a trigger 108, hinge 110, safety 112, and a forward electronic module 114, which may provide either or both a forward-facing camera 114*a* or a laser 114*b*.

Figure 2:
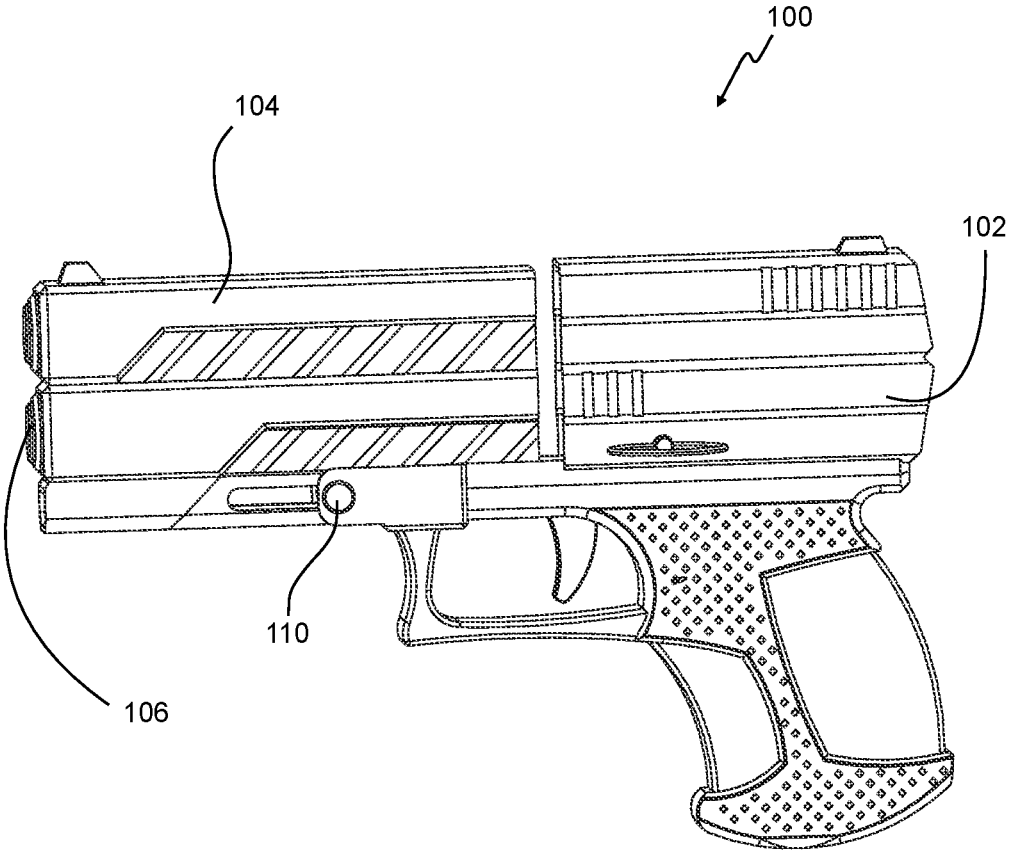
FIG. 2 illustrates a side view of the single-use firearm, with the barrel component shown in a pre-affixed position.
Figure 3:
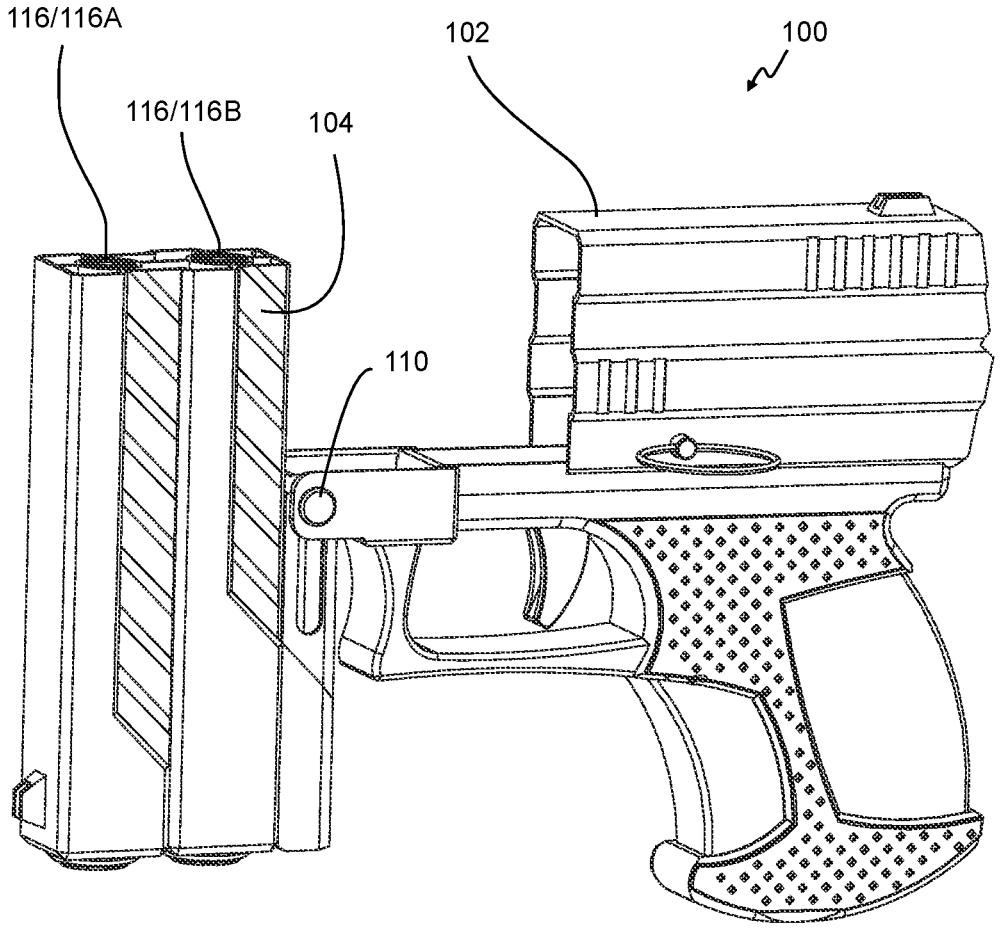
FIG. 3 illustrates a side isometric view of the single-use firearm, with the barrel component in a hinged and pre-affixed position.

FIG. 2 illustrates a side view of the single-use firearm 100, with barrel housing member 104 component shown in a pre-affixed position. The barrel housing member 104 may be seen slid onto the frame 102 of the firearm once loaded, and affixed thereto, whereby once coupled to the frame 102, the barrel housing member 104 cannot be detached without permanently damaging the firearm 100, rendering it unrepairable. The hinge 110 allows the barrel to pivot, as shown in FIG. 3, for loading ammunition prior to sliding said barrel housing member 104 into position for permanent couplement. FIG. 3 illustrates a side isometric view of the single-use firearm 100, with the barrel housing member 104 component in a hinged and pre-affixed position. This position allows for loading of the ammunition/cartridge(s) 116. However, hinging the barrel housing member 104 also allows for different barrels 106 to be installed, allowing a user to load ammunition of varying calibers (as shown more particularly in FIG. 9).

Figure 4:
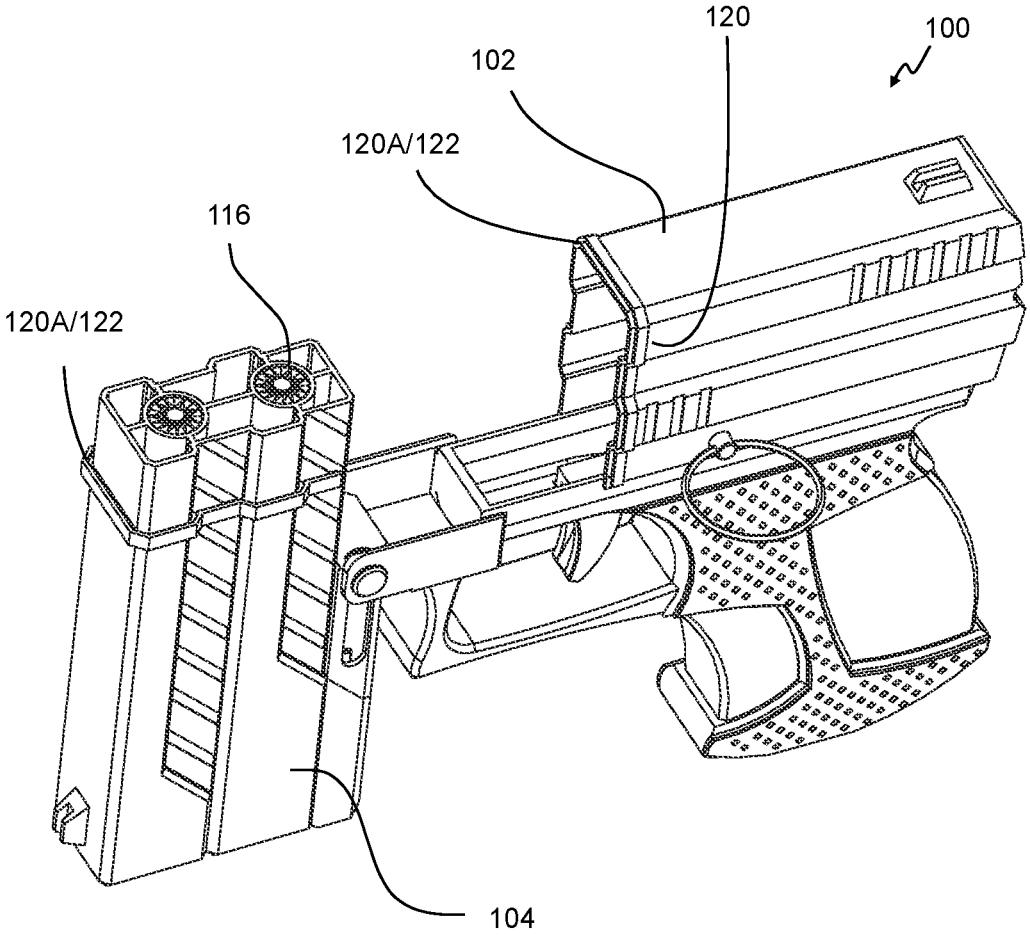
FIG. 4 shows a side isometric view of the single use firearm in a position similar to that of FIG. 3, illustrating a system with an adhesive coupling mechanism.

FIG. 4 shows a side isometric view of the single-use firearm 100 in a position similar to that of FIG. 3, illustrating a system with adhesive coupling mechanism 120A. In order to create a permanent bond, the barrel housing member 104 may have an adhesive element 122 applied to both a barrel housing member 104 and the frame 102, whereby once engaged, forms a permanent bond. The adhesive may be applied to one surface or both, or may be a two-part application, whereby the bond forms when a substance on a barrel portion comes into contact with and engages with a substance on a frame portion.

Figure 5:
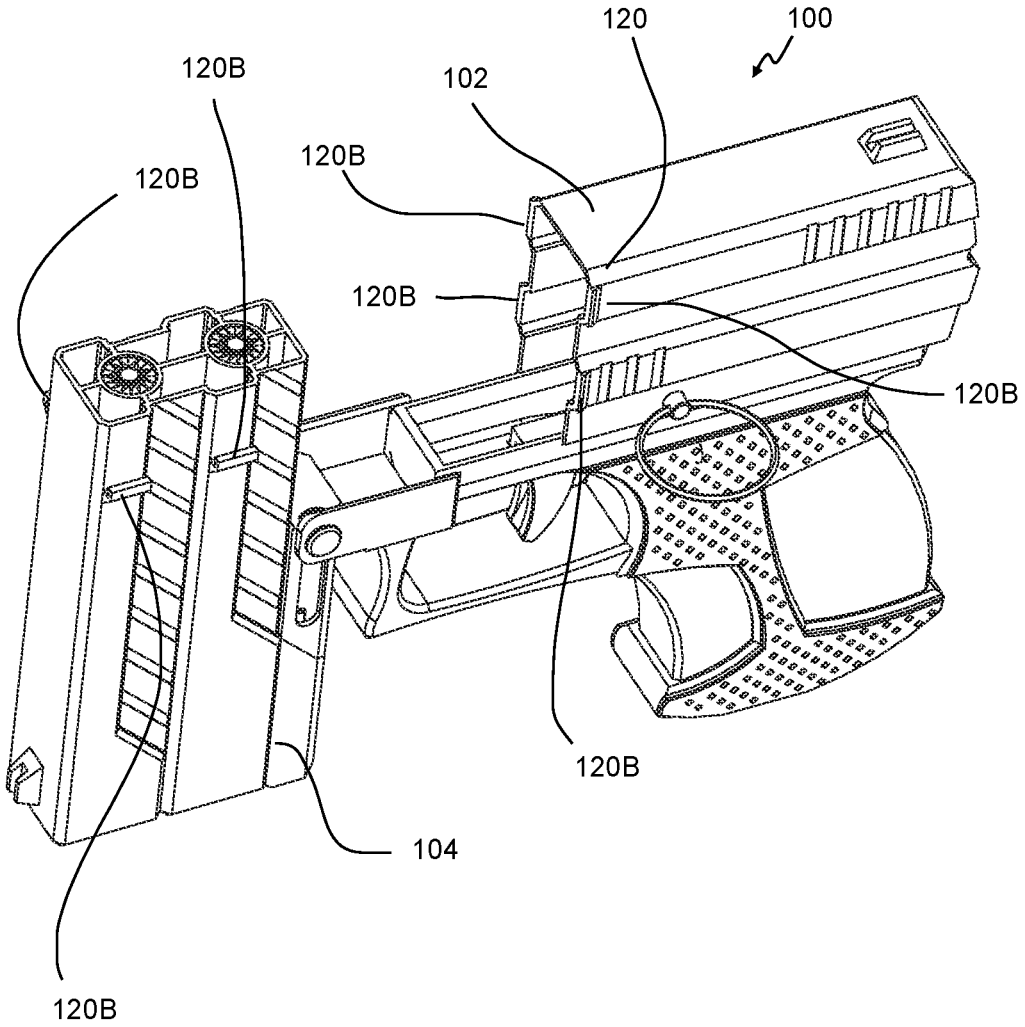
FIG. 5 shows a side isometric view of the single use firearm in a position similar to that of FIG. 3, illustrating a system with a snap coupling mechanism.

FIG. 5 shows a side isometric view of the single-use firearm in a position similar to that of FIG. 3, illustrating a system with snap coupling mechanism 120B. Unlike the adhesive, which would need to be applied, a snap system 120B would mechanically engage the components to couple and form a fixed connection. This type of connector is commonly known as a "snap-fit connector" or "snap fastener." Snap-fit connectors utilize a series of triangular-shaped protrusions, often called "snaps" or "clips," that engage with corresponding recesses or slots on a flat member. These snaps are designed to flex or deform when pressure is applied, allowing them to pass over the flat member and securely lock into place once they snap back into their original position. This forms a permanent connection between the two components, ensuring a secure and reliable attachment.

Figure 6:
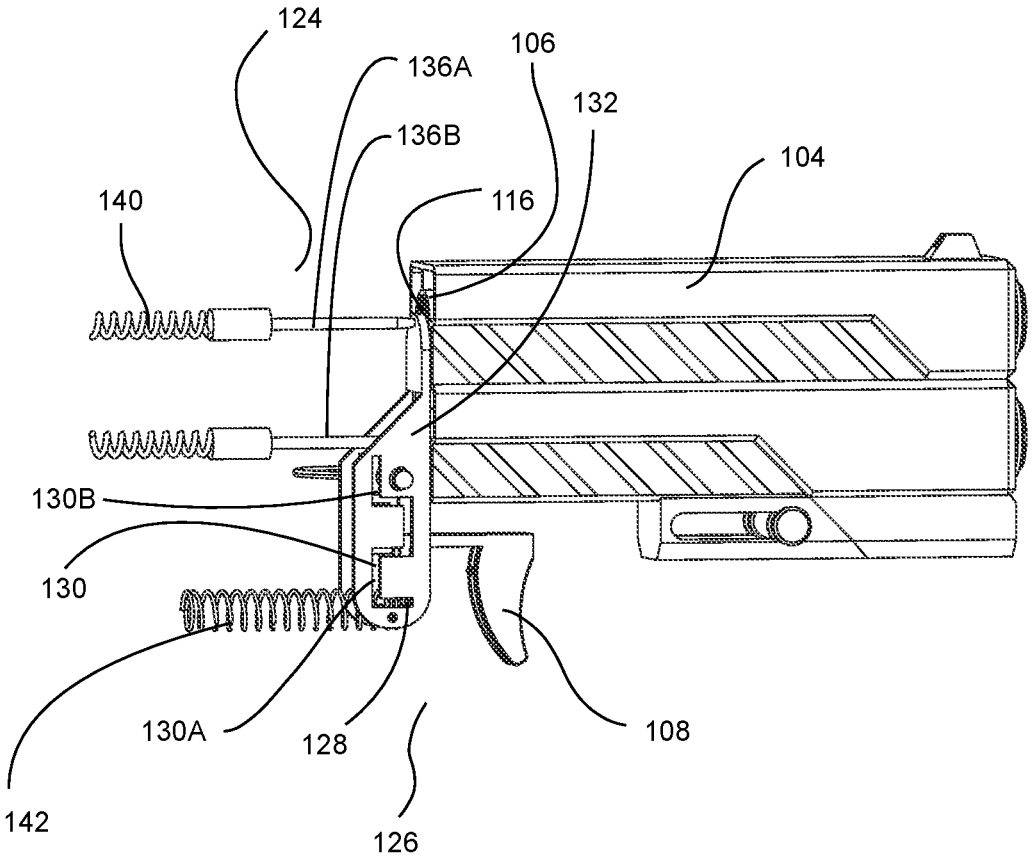
FIG. 6 illustrates the spring-loaded firing pins and trigger mechanism, isolated, with an isometric side view of the barrel component to conceptualize the firing mechanism on two pre-loaded cartridges within the barrel component.

FIG. 6 illustrates the springs 140 and the spring-loaded firing pins 124 and trigger mechanism 126, isolated, with an isometric side view of the barrel housing member 104 to conceptualize the firing mechanism 126 on two pre-loaded cartridges 116 within the barrels 106 of the barrel housing member 104. The trigger mechanism includes a trigger 108, having protrusions 128 that fit into a pair of sequentially incremental channels 130 of a firing pin containment mechanism (also called slide plate) 132. These channels 130 provide for a sequence of actions once the trigger 108 is depressed, executing a first action on a first depression, wherein the first action includes the protrusions 128 slide horizontally through the channel to a first vertical portion 130A of the channel 130. The firing pin containment mechanism 132, which is spring activated by a spring 138 in tension (see FIGS. 8A-8C), slides down, thereby releasing the first uppermost firing pin 136A, which strikes the cartridge 116 primer, thereby firing a first shot. On a second depression of the trigger 108 a second action is executed, wherein the second action includes the protrusions 128 sliding horizontally through the channel to a second vertical portion 130B of the channel 130. The firing pin containment mechanism 132, which is spring activated by a spring 138 in tension, slides down, thereby releasing a second lowermost firing pin 136B, which strikes the cartridge 116 primer, thereby firing a second shot.

Figure 7:
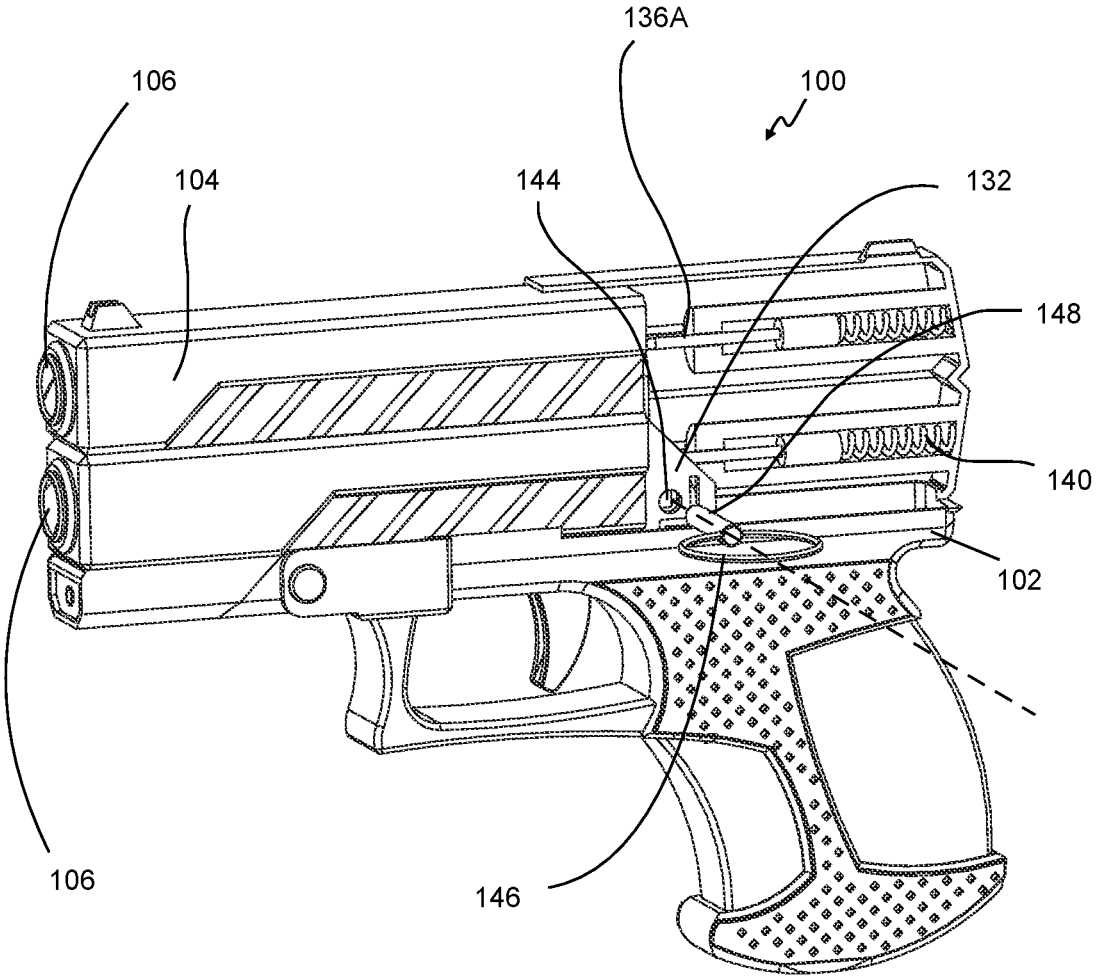
FIG. 7 illustrates an isometric view of a firearm, similar to FIG. 1, with a cutaway section of the frame member, showing the removal of the pull-pin-style safety mechanism from an aperture in the trigger mechanism.
Figures 8A, 8B, 8C:
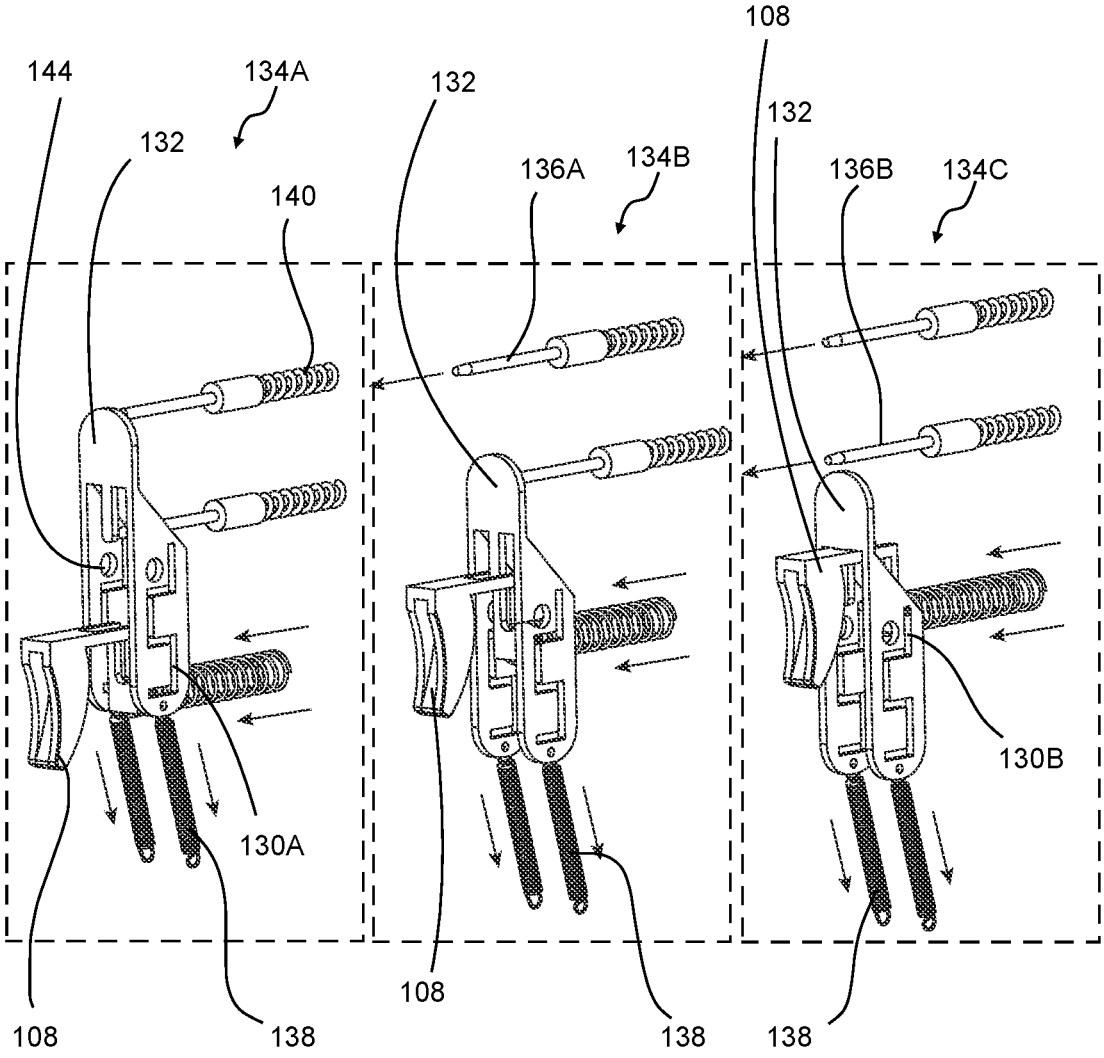
FIG. 8A illustrates an isolated isometric view of the firing mechanism with both firing pins contained in a compressed state.
FIG. 8B illustrates an isolated isometric view of the firing mechanism with a first firing pin in an uncompressed state, and a second firing pin contained in a compressed state.
FIG. 8C illustrates an isolated isometric view of the firing mechanism with both firing pins in an uncompressed state.

FIG. 8A illustrates an isolated isometric view of the firing mechanism 126 with both firing pins 136A/136B contained in a compressed state. FIG. 8B illustrates an isolated isometric view of the firing mechanism 126 with a first firing pin 136A in an uncompressed state, and a second firing pin 136B contained in a compressed state. FIG. 8C illustrates an isolated isometric view of the firing mechanism 126 with both firing pins 136A/136B in an uncompressed state. The functionality of the mechanism 126 is described above, but shown in the FIGS. 8A-8C are area springs 138 that exist in tension to pull down the firing pin containment mechanism 132, trigger 108, and first and second firing pins 136A/136B. First and second firing pins 136A/136B are powered by compressed springs 140 and a trigger spring 142. Also shown is the safety aperture 144, discussed below in regard to FIG. 7.

After the second shot, both firing pins 136A/136B have been released forward, and the firing pin containment mechanism 132 is in a final state and cannot be raised without opening up the firearm and resetting the springs in the firing mechanism 126. Because the permanent construction of the firearm, the body cannot be opened without permanently damaging the firearm, thereby resulting in the single-use performance of the system.

FIG. 7 illustrates an isometric view of a firearm 100, similar to FIG. 1, with a cutaway section of the frame member 102, showing the removal of the pull safety 146 from an aperture 144 in the trigger mechanism 126. The pull safety 146 includes a bar 148 that locks the firing pin containment mechanism 132. However, when pulled, the firing pin containment mechanism 132 is free to move to one of several positions, and the firearm is live. The pull-pin-style safety mechanism 146 also engages a contact sensor 150 whereby when the pull-pin-style safety mechanism 146 is pulled out, the sensor reports that the firearm is live to a control module 152, thereby allowing a tracking and monitoring system to activate.

Figure 9:
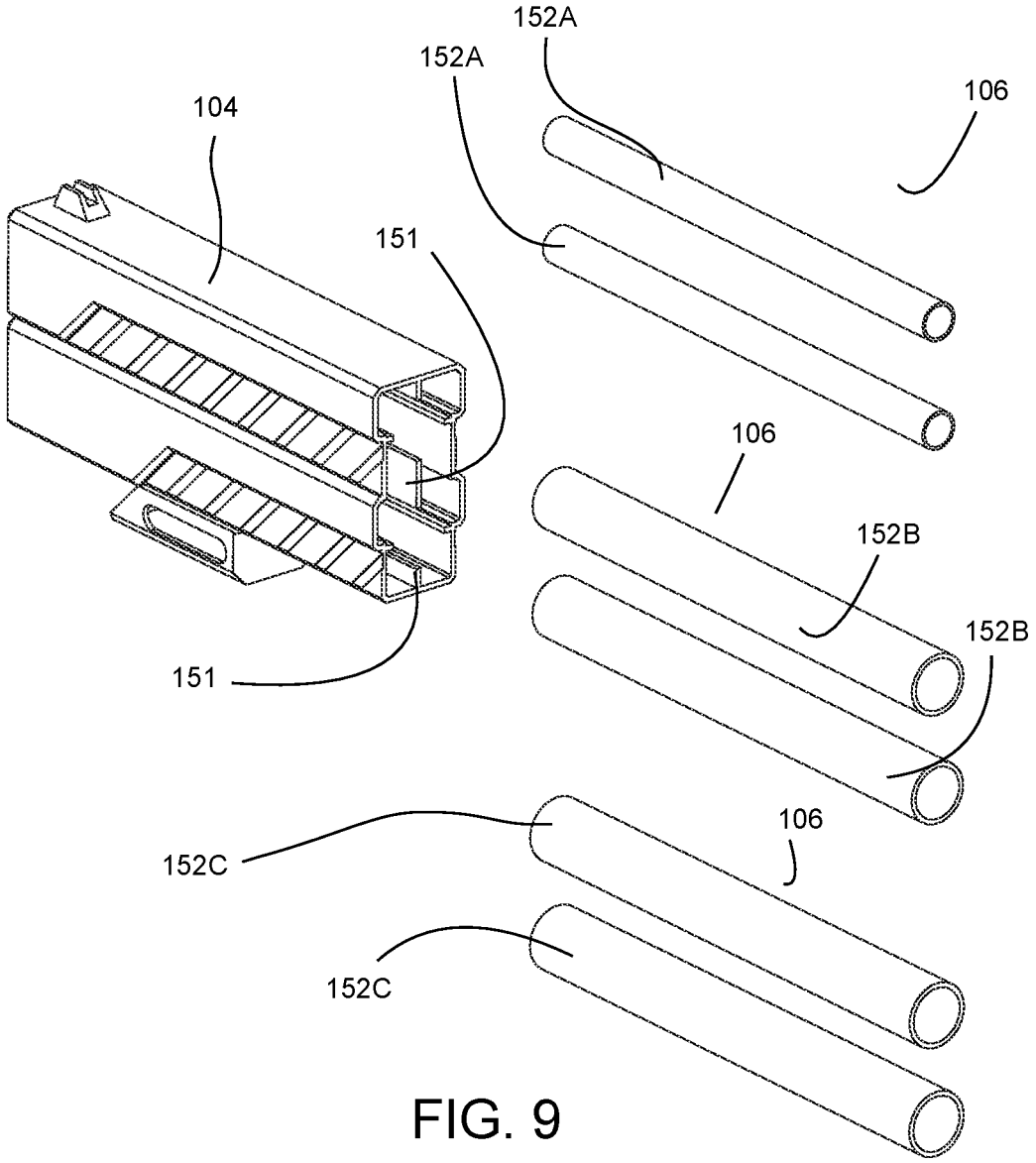
FIG. 9 illustrates a rear isometric view of the barrel component with removable barrels varying in diameter.

FIG. 9 illustrates a rear isometric view of the barrel housing member 104 with removable barrels 152A/152B/152C varying in diameter. These barrels 152A/152B/152C may be selected or swapped out prior to affixing the barrel housing member 104 to the frame 102, so that the user can select the preferred caliber of available ammunition. Many applications will use a traditional steel barrel with rifled bore. Alternatively, because the firearm is single-use, the barrel need only need be used one time, thereby allowing cheaper material, such as plastic to be used if desired. However, this creates an issue with rifling. Therefore, in embodiments with plastic barrels, the bullet itself may contain rifling properties to influence proper rotation. In other embodiments, these removable barrels 152A/152B/152C will be constructed of rifled steel. Therefore, an additional benefit of the interchangeable barrels allows for user's to select both the caliber of the ammunition, and the material of the barrel. Barrels are supported on a top, bottom, and sides by frame members 151, which allow the barrel housing member 104 to remain light while giving the barrels 106 therein structure and support. Smaller diameter barrels 152A may support smaller caliber ammunition, such as a 0.22 cartridge, medium barrels 152B may support medium sized ammunition, such as a 9 mm cartridge, and large barrels 152C may be appropriate for larger sized hand gun rounds, like a 0.45 cartridge.

Figure 10A:
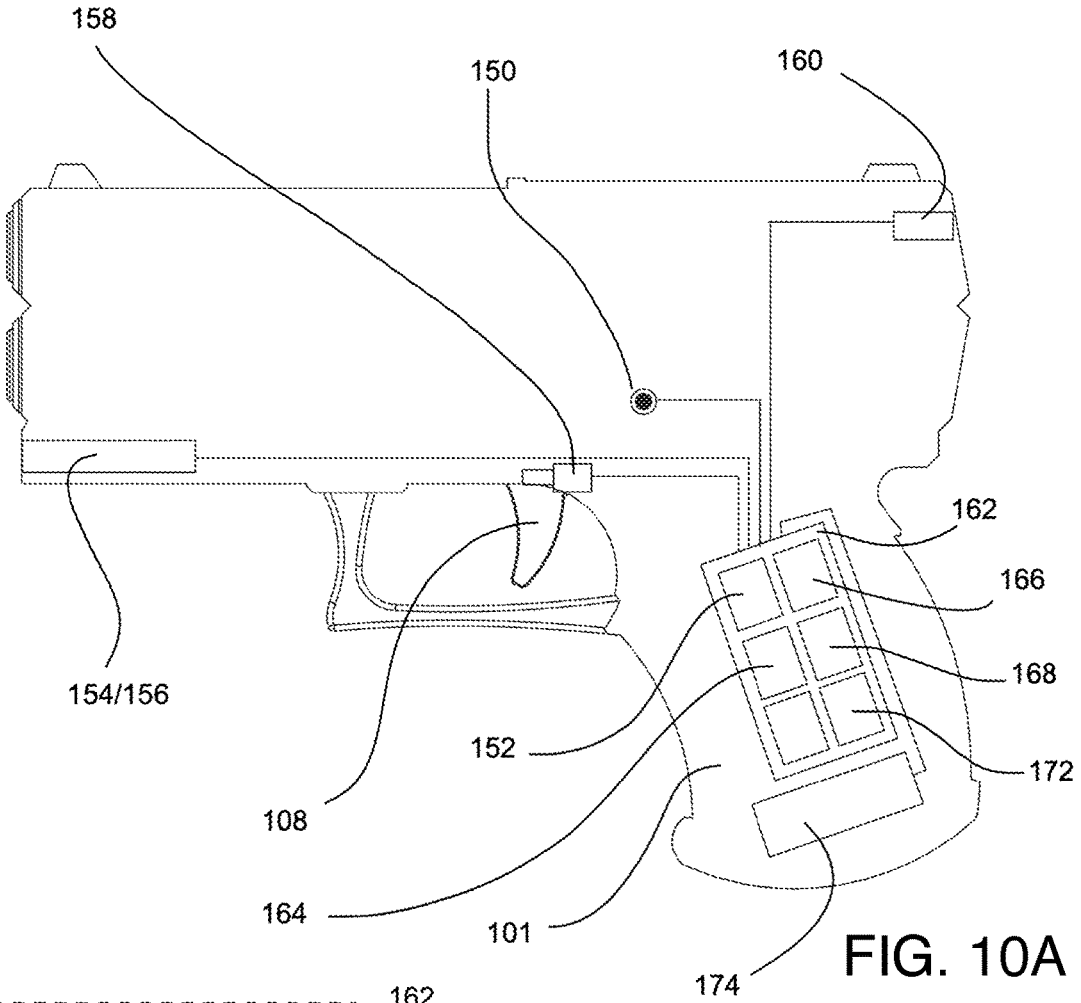
FIG. 10A illustrates a diagram of the electronic components within the single-use firearm.
Figure 10B:
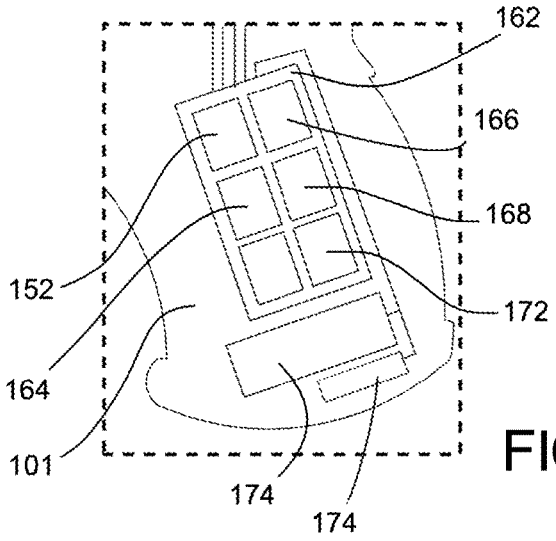
FIG. 10B illustrates an enlarged view of the electronic components in a grip portion of the firearm shown in FIG. 10A of an embodiment with a secondary battery.

FIG. 10A illustrates a diagram of the electronic components within the single-use firearm. As may be noticed, several of the electrical components are housed in the handle 101 of the firearm 100. The handle 101 has an ample amount of space to contain electronics because there is no clip for refillable ammunition. As may be seen, sensors and electronic components may be seen throughout the firearm, including a contact sensor 150 for detecting pulls of the pull-pin-style safety mechanism, a forward-facing camera 154 or laser 156 (or combination thereof), and a rear facing camera 160. The cameras are used to record once an event, such as disarming the safety or pulling a trigger. A trigger sensor 158 is also shown, wherein the trigger sensor 158 can detect trigger pulls and relay to a control board a notification a fire has occurred. In some embodiments, the trigger sensor includes a pressure detector to detect if the trigger has been pulled, as appreciated from the representation in the figure. Because this piece is moveable, the sensor is also capable of deactivating the firearm by locking the moveable component, such as with use of a magnetic solenoid. This construction provides a means for disabling the functionality of the firearm. FIG. 10A also shows the control board 162 which may house several of the electronic components, including the control module 152, such as a CPU, memory 164, geolocation module 166, accelerometer 168, communication module 170 as a network interface (which may include a cellular network transmitter/receiver, Bluetooth transmitter/receiver, and/or Wi-Fi transmitter/receiver, as well as Near Field Communication (NFC) and Radio Frequency Identification (RFID) circuitry). A video processing unit 172 may be included as well to process and send a video feed captured by front and back cameras. In addition, cameras 154/160 may include a built-in microphone, or a microphone/speaker may be incorporated into the firearm for 2-way communication with a monitoring station. A power source, such as a battery 174 is also shown. The battery 174 may be single use, or rechargeable. In some embodiments, a secondary battery 174*a* may exist, as shown in FIG. 10B.

Figure 11A:
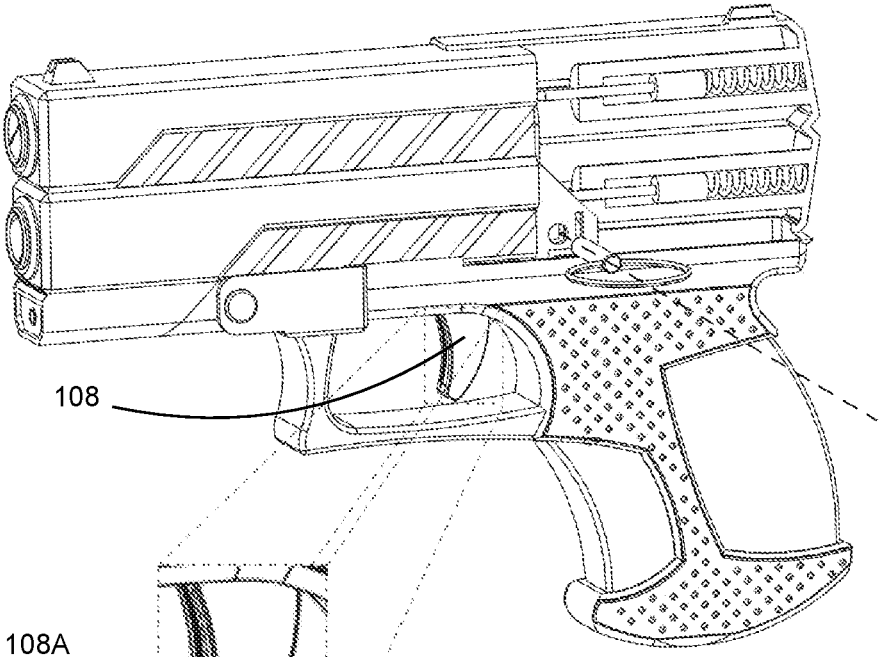
FIG. 11A is an illustration similar to FIG. 7, showing the additional trigger lock.
Figure 11B:
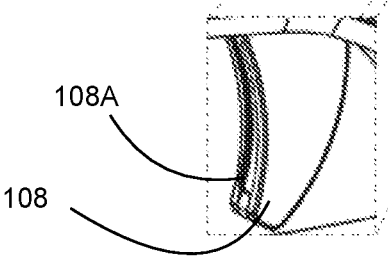
FIG. 11B illustrates an enlarged view of the trigger and trigger lock combination.
Figure 11C:
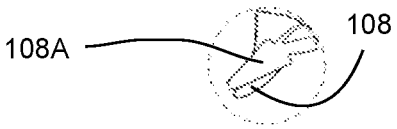
FIG. 11C illustrates an undepressed trigger lock.
Figure 11D:
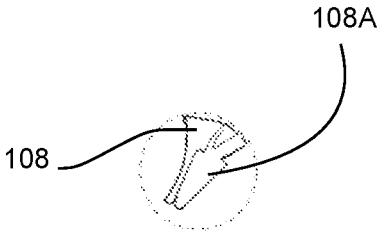
FIG. 11D illustrates a depressed trigger lock.

FIGS. 11A-11D illustrate an embodiment incorporating another safety aspect of the invention. The trigger 108 mechanism shown incorporates a safety lock 108A, which keeps the trigger from firing when the trigger 108 alone is depressed. Trigger locks have become standard in some handgun models, such as those manufactured by Springfield Armory. This trigger lock 108A offers an additional level of protection for those who are concerned about use misuse. FIG. 11A is an illustration similar to FIG. 7 but showing the additional trigger lock 108A. FIG. 11B illustrates an enlarged view of the trigger 108 and trigger lock 108A combination. FIG. 11C illustrates an undepressed trigger lock 108A, and FIG. 11D illustrates a depressed trigger lock 108A.

Figure 12:
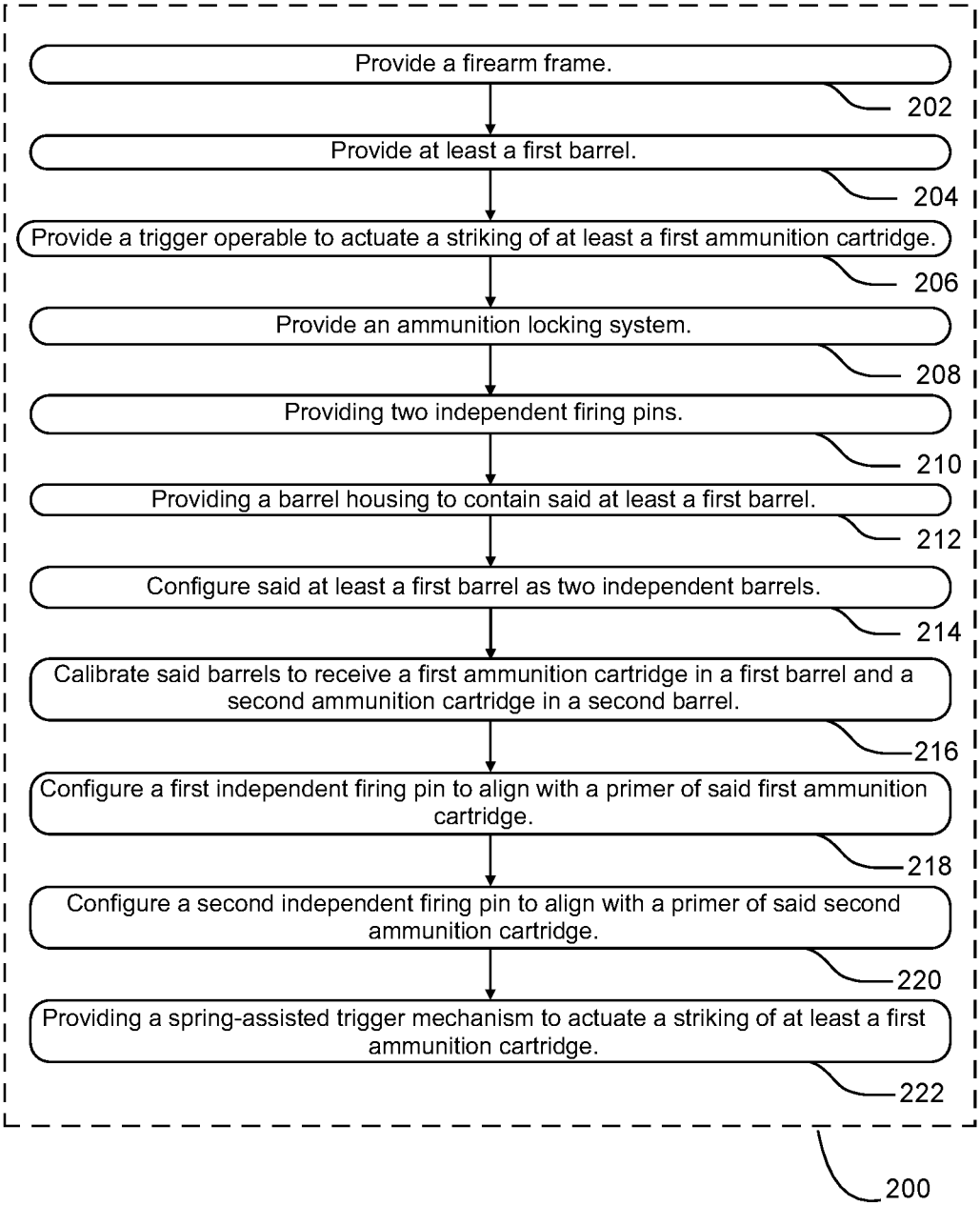
FIG. 12 illustrates a flow chart of the method for personal defense.

FIG. 12 illustrates a flow chart of the method for personal defense. The shown method includes providing 202 a firearm frame 102, providing 204 at least a first barrel 106, providing 206 a trigger 108 operable to actuate a striking of at least a first ammunition cartridge 116, and providing 208 an ammunition locking system 120, wherein the ammunition locking system 120 permanently locks the at least first ammunition cartridge 116 within the firearm 100, whereby once locked, the at least a first ammunition cartridge 116 may not be removed or reloaded without permanently damaging the firearm 100, providing 210 two independent firing pins 136A/136B, and providing 212 a barrel housing 104 to contain said at least a first barrel 106, wherein said barrel housing member is pivotally connected by a hinge mechanism 110 to said firearm frame 102, wherein said at least a first barrel 106 is configured 214 to comprise two independent barrels 106A/106B calibrated 216 to receive a first ammunition cartridge 116A in a first barrel 106A and a second ammunition cartridge 116B in a second barrel 106B, whereby a first independent firing pin 136A is configured 218 to align with a primer of said first ammunition cartridge 116A, and a second independent firing pin 136B is configured 220 to align with a primer of said second ammunition cartridge 116B. The method also includes providing 222 a spring-assisted trigger mechanism 132/138/142 to actuate a striking of at least a first ammunition cartridge 116A.

Figure 13:
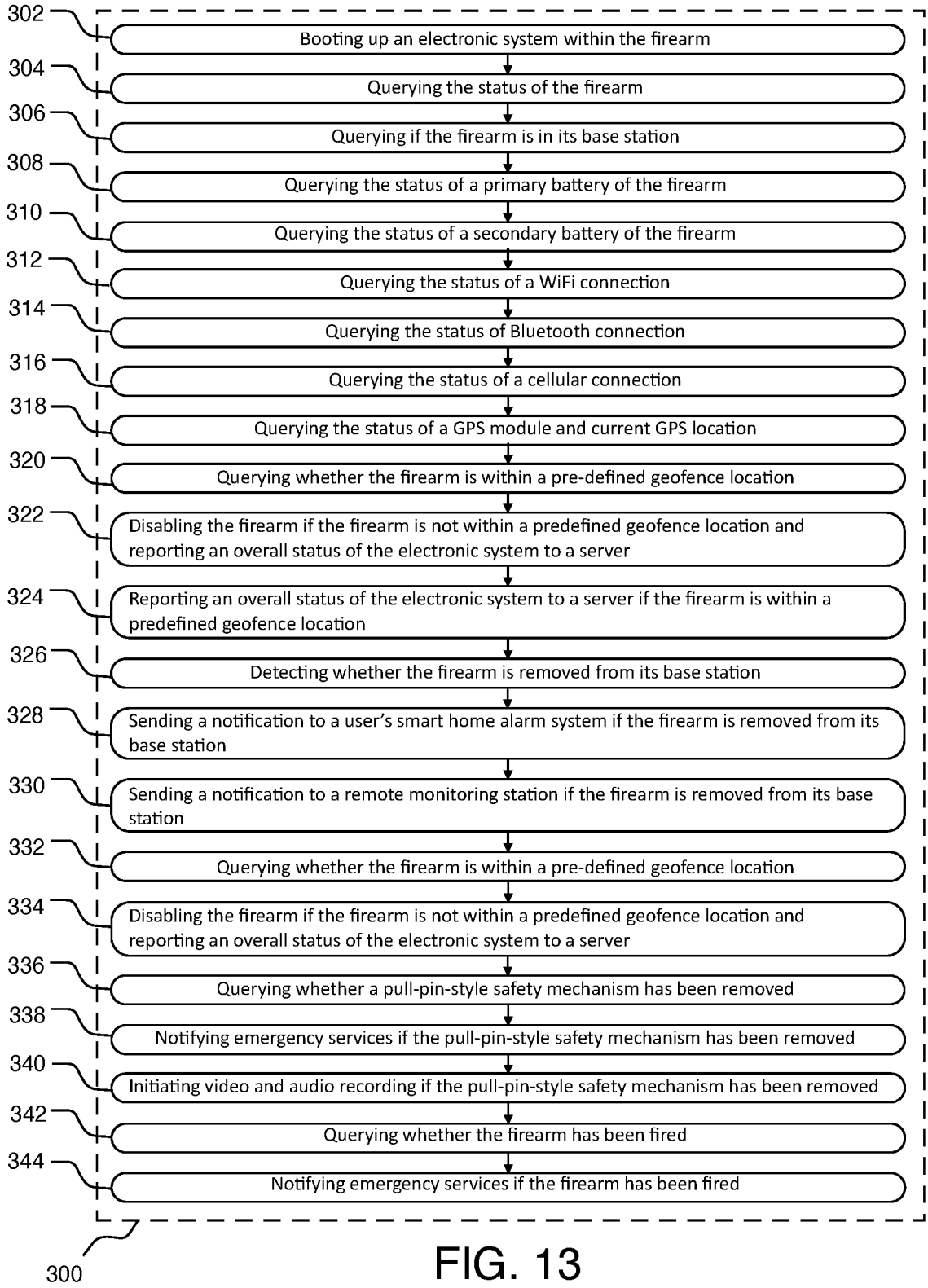
FIG. 13 illustrates a flow chart of a tracking and monitoring program stored on a memory in the electronic system of the single-use firearm.

FIG. 13 illustrates a flow chart of a tracking and monitoring program stored on a memory in the electronic system of the single-use firearm. The program includes the steps of: booting 302 up an electronic system within the firearm, querying 304 the status of the firearm, querying 306 if the firearm is in its base station, querying 308 the status of a primary battery 174 of the firearm 100, querying 310 the status of a secondary battery 174*a* of the firearm, querying 312 the status of a WiFi connection, querying 314 the status of a Bluetooth connection, querying 316 the status of a cellular connection, querying 318 the status of a GPS module and current GPS location, querying 320 whether the firearm is within a pre-defined geofence location, disabling 322 the firearm if the firearm is not within a predefined geofence location and reporting an overall status of the electronic system to a server, reporting 324 an overall status of the electronic system to a server if the firearm is within a predefined geofence location, detecting 326 whether the firearm is removed from its base station, sending 328 a notification to a user's smart home alarm system if the firearm is removed from its base station, sending 330 a notification to a remote monitoring station if the firearm is removed from its base station, querying 332 whether the firearm is within a pre-defined geofence location, disabling 334 the firearm if the firearm is not within a predefined geofence location and reporting an overall status of the electronic system to a server, querying 336 whether a pull-pin-style safety mechanism has been removed, notifying 338 emergency services if the pull-pin-style safety mechanism has been removed, initiating 340 video and audio recording if the pull-pin-style safety mechanism has been removed, querying 342 whether the firearm has been fired, and notifying 344 emergency services if the firearm has been fired.

Figure 14:
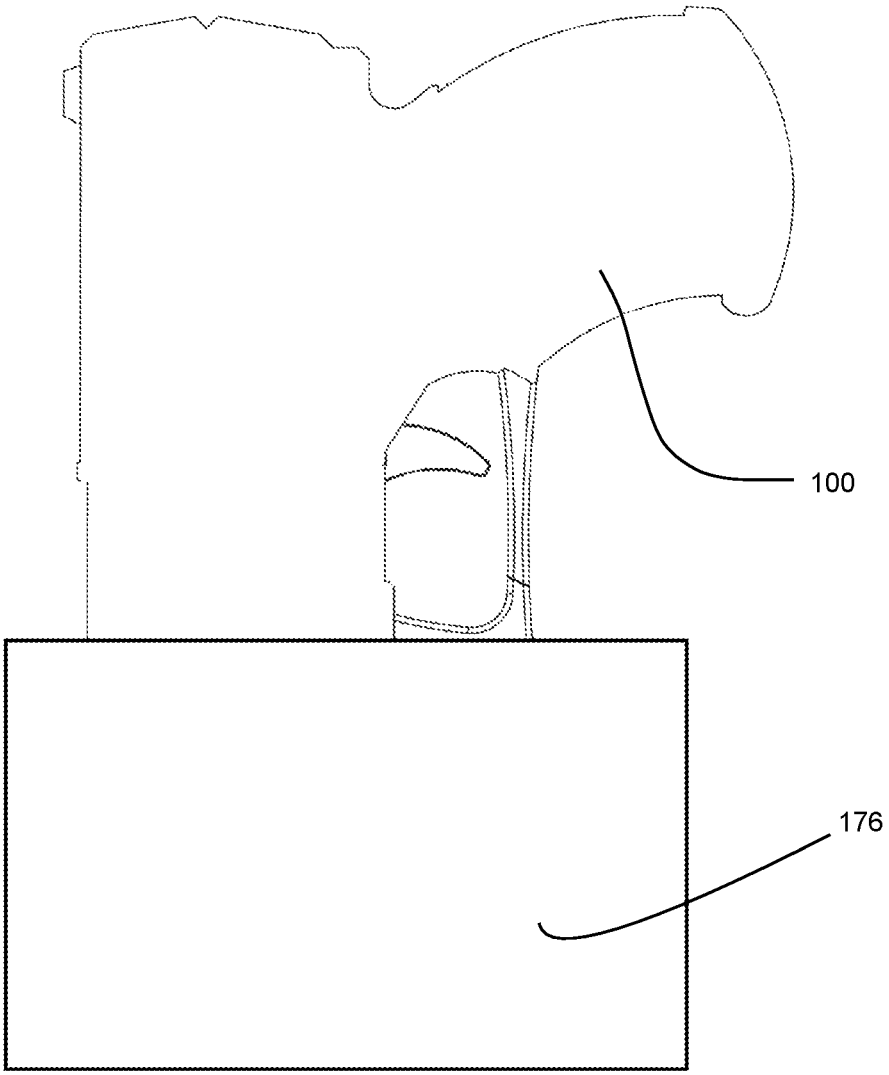
FIG. 14 illustrates the single-use firearm in its base station.

FIG. 14 illustrates the single-use firearm 100 in its base station 176.

Figure 15:
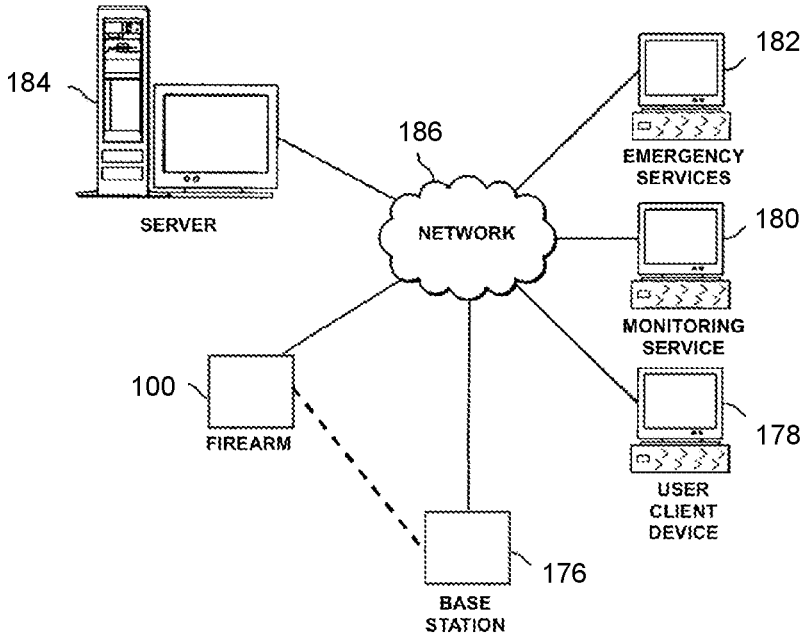
FIG. 15 illustrates a network diagram of communication for the tracking and monitoring program stored on a memory in the electronic system of the single-use firearm.

FIG. 15 illustrates a network diagram of communication for the tracking and monitoring program stored on a memory in the electronic system of the single-use firearm. The firearm 100 can be seen connecting to both a network 186 and the base station 176. In some embodiments, the base station may also be connected to the network 186, typically by WiFi. The firearm 100 may be connected by cellular or WiFi, and the firearm 100 may connect to the base station 176 by WiFi or Bluetooth. A server 184 may contain a complementary program to route the received data from the network 186 and direct it to an emergency service 182, such as dialing 911, or direct it to a monitoring station service 180, which may be connected to a user's smart home system or home alarm system. In some embodiments, the monitoring service 180 may also connect to emergency service 182, and dial 911, thereby dispatching police to the firearm's location. Other notifications may be pushed to a user client device 178, such as a smart phone or personal computer so the owner of the firearm 100 is aware if any misuse takes place.

In an exemplary embodiment, a single-use firearm 100 capable of firing a projectile is provided. The single-use firearm 100 capable of firing a projectile comprises a firearm frame 102, at least a first barrel 106, a trigger 108 operable to actuate a striking of at least a first ammunition cartridge 116, and an ammunition locking system 120, wherein said ammunition locking system 120 permanently locks said at least first ammunition cartridge 116 within said firearm 100, whereby once locked, said at least a first ammunition cartridge 116 may not be removed or reloaded without permanently damaging said firearm 100. The single-use firearm 100 of the exemplary embodiment also includes an electronic system configured within said firearm frame 102 having at least a communication module 170, a geolocation module 166, at least one camera 154/160 with microphone, a control module 152 of an internal circuitry 162 with a processor, a battery **174/174*a*, a means for disabling said firearm 100 (see trigger sensor 158, shown in FIG. 10A, wherein this piece is moveable, and the sensor is also capable of deactivating the firearm by locking the moveable component, such as with use of a magnetic solenoid. This construction provides a means for disabling the functionality of the firearm), and a memory 164 with a program 300 stored thereon that, when executed by said processor of said control module performs the steps of: booting 302 up an electronic system within the firearm, querying 304 the status of the firearm, querying 306 if the firearm is in its base station, querying 308 the status of a primary battery 174 of the firearm 100, querying 310 the status of a secondary battery 174*a* of the firearm, querying 312 the status of a WiFi connection, querying 314 the status of a Bluetooth connection, querying 316 the status of a cellular connection, querying 318 the status of a GPS module and current GPS location, querying 320 whether the firearm is within a pre-defined geofence location, disabling 322 the firearm if the firearm is not within a predefined geofence location and reporting an overall status of the electronic system to a server, reporting 324 an overall status of the electronic system to a server if the firearm is within a predefined geofence location, detecting 326 whether the firearm is removed from its base station, sending 328 a notification to a user's smart home alarm system if the firearm is removed from its base station, sending 330 a notification to a remote monitoring station if the firearm is removed from its base station, querying 332 whether the firearm is within a pre-defined geofence location, disabling 334 the firearm if the firearm is not within a predefined geofence location and reporting an overall status of the electronic system to a server, querying 336 whether a pull-pin-style safety mechanism has been removed, notifying 338 emergency services if the pull-pin-style safety mechanism has been removed, initiating 340 video and audio recording if the pull-pin-style safety mechanism has been removed, querying 342 whether the firearm has been fired, and notifying 344** emergency services if the firearm has been fired.

In some embodiments of the single-use firearm 100, the at least a first barrel 106 is located in a barrel housing member 104, wherein said barrel housing member 104 is pivotally connected by a hinge mechanism 110 to said firearm frame 102.

In some embodiments the single-use firearm 100 capable of firing a projectile further comprises two independent firing pins 136A/136B. The trigger 108 operable to actuate a striking of at least a first ammunition cartridge includes a spring-assisted trigger mechanism 132/138/142. The at least a first barrel 106 is further defined as being two independent barrels 106A/106B calibrated to receive a first ammunition cartridge 116A in a first barrel 106A and a second ammunition cartridge 116B in a second barrel 106B, whereby a first independent firing pin 136A is configured to align with a primer of said first ammunition cartridge 116A, and a second independent firing pin 136B is configured to align with a primer of said second ammunition cartridge 116B.

In some embodiments of the single-use firearm 100, each independent firing pin 136A/136B in said two independent firing pins is a block firing pin with pre-compressed springs 140 contained in a compressed state by a spring-assisted firing pin containment mechanism 132 having a first position **134*a* (shown in FIG. 8A), a second position 134B (shown in FIG. 8B), and a third position 134C (shown in FIG. 8C). The first position 134A of said spring-assisted firing pin containment mechanism 132 is in an uppermost orientation, keeping both firing pins 136A/136B compressed state. The second position 134B of said spring-assisted firing pin containment mechanism 132 is an interim orientation, allowing said first firing pin 136A to release while keeping said second firing pin 136B in a compressed state. The third position 136C of said spring-assisted firing pin containment mechanism 132 is in a lowermost orientation, allowing said second firing pin 136**B to release.

Some embodiments of the single-use firearm 100 further include a safety aperture 144 extending through a trigger mechanism 108 and a firing pin containment mechanism 132. A removeable pull-pin-style safety mechanism 146, wherein said removeable pull-pin-style safety mechanism includes a bar 148 that locks the firing pin containment mechanism 132 when said bar 148 extends through said safety aperture 144 in said trigger mechanism 108 and said firing pin containment mechanism 132.

Some embodiments of the single-use firearm 100 further include an electronic contact 150 trigger capable of sending an electronic signal to a control module 152 of an internal circuitry 162 once said removeable pull-pin-style safety mechanism 146 is removed from said safety aperture 144. The internal circuitry 162 includes at least a communication module 170 which may provide for cellular connectivity, Bluetooth connectivity, and Wi-Fi connectivity, a battery 174, and said control module 152, capable of receiving a signal from said electronic contact trigger 150. The control module 152 is configurably capable of executing a program stored on a memory 164 to send a signal by said communication module 170 notifying a receiving party that said removeable pull-pin-style safety mechanism 146 has been removed. Some embodiments further include a geolocation module 166 coupled to said control module 152, wherein said geolocation module 166 is capable of identifying a physical location of said firearm 100, and relaying said location information to said control module 152. Some embodiments of the single-use firearm 100 further include a forward-facing camera 154 to visually capture the target, a rear-facing camera 160 to visually capture the user, and/or a laser 156 for aim assistance.

In some embodiments of the single-use firearm 100, the ammunition locking system 120 further comprises an adhesive 120A placed on at least one of said firearm frame 102 and/or a barrel housing member 104, wherein said adhesive 120A is placed on a surface facing an opposing member 102/104, whereby once pressed together, said firearm frame 102 and said barrel housing member 104 are permanently affixed. In other embodiments of the single-use firearm 100, the ammunition locking system 120 further comprises a plurality of snaps 120B, wherein snap elements 120B are positioned on said firearm frame member 102 on a side surface, and complemental snap elements 120B are positioned on a barrel housing member 104, whereby once pressed together, said firearm frame 102 and said barrel housing member 104 are permanently affixed. Additional embodiments may incorporate both the adhesive 120A and the snap elements 120B, though other equivalent affixation means may also suffice.

In some embodiments of the single-use firearm 100, the at least a first barrel 106 is comprised of a plastic material. Embodiments with plastic barrels 106 may also require a bullet with rifling groves thereon. While the bullet is not shown in the figures specifically, rifling is a technique used and employed with barrel bores in the industry, and those same principles may be readily applied to bullets. In other embodiments, the barrel(s) 106 is comprised of a rifled steel material.

In some embodiments, the barrel(s) 106 includes at least one selectably insertable barrel 152A/152B/152C. The at least one selectably insertable barrel 152A/152B/152C may be selected from a plurality of barrels 152A/152B/152C with varying bore diameters corresponding with to differing cartridge calibers.

In another exemplary embodiment, a method 200 for personal defense implementing a single-use firearm 100 capable of firing a projectile is disclosed. The method comprises steps of providing 202 a firearm frame 102, providing 204 at least a first barrel 106, providing 206 a trigger 108 operable to actuate a striking of at least a first ammunition cartridge 116, and providing 208 an ammunition locking system 120, wherein the ammunition locking system 120 permanently locks the at least first ammunition cartridge 116 within the firearm 100, whereby once locked, the at least a first ammunition cartridge 116 may not be removed or reloaded without permanently damaging the firearm 100.

In some embodiments, the method 200 for personal defense implementing a single-use firearm 100 capable of firing a projectile further comprising the steps of providing 210 two independent firing pins 136A/136B, and providing 212 a barrel housing 104 to contain said at least a first barrel 106, wherein said barrel housing member is pivotally connected by a hinge mechanism 110 to said firearm frame 102, wherein said at least a first barrel 106 is configured 214 to comprise two independent barrels 106A/106B calibrated 216 to receive a first ammunition cartridge 116A in a first barrel 106A and a second ammunition cartridge 116B in a second barrel 106B, whereby a first independent firing pin 136A is configured 218 to align with a primer of said first ammunition cartridge 116A, and a second independent firing pin 136B is configured 220 to align with a primer of said second ammunition cartridge 116B. The method also includes providing 222 a spring-assisted trigger mechanism 132/138/142 to actuate a striking of at least a first ammunition cartridge 116A.

While there has been shown and described above the preferred embodiment of the instant invention it is to be appreciated that the invention may be embodied otherwise than is herein specifically shown and described and that certain changes may be made in the form and arrangement of the parts without departing from the underlying ideas or principles of this invention as set forth in the Claims appended herewith.

I claim:

1. A single-use firearm capable of firing a projectile, comprising:

a firearm frame;

at least a first barrel;

a trigger operable to actuate a striking of at least a first ammunition cartridge;

an ammunition locking system, wherein said ammunition locking system permanently locks said at least first ammunition cartridge within said firearm, whereby once locked, said at least a first ammunition cartridge may not be removed or reloaded without permanently damaging said firearm; and an electronic system configured within said firearm frame having at least a communication module, a geolocation module, at least one camera with microphone, a control module of an internal circuitry with a processor, a battery, a means for disabling said firearm, and a memory with a program stored thereon that, when executed by said processor of said control module performs the steps of:

booting up an electronic system within the firearm;

querying the status of the firearm;

querying if the firearm is in its base station;

querying the status of a primary battery of the firearm;

querying the status of a secondary battery of the firearm;

querying the status of a wireless local area network (WLAN) connection;

querying the status of a a short-range wireless communication protocol connection;

querying the status of a cellular connection;

querying the status of a Global Positioning System module and current Global Positioning System location;

querying whether the firearm is within a pre-defined geofence location;

disabling the firearm if the firearm is not within a predefined geofence location and reporting an overall status of the electronic system to a server;

reporting an overall status of the electronic system to a server if the firearm is within a predefined geofence location;

detecting whether the firearm is removed from its base station;

sending a notification to a user's smart home alarm system if the firearm is removed from its base station;

sending a notification to a remote monitoring station if the firearm is removed from its base station;

querying whether the firearm is within a pre-defined geofence location;

disabling the firearm if the firearm is not within a predefined geofence location and reporting an overall status of the electronic system to a server;

querying whether a pull-pin-style safety mechanism has been removed;

notifying emergency services if the pull-pin-style safety mechanism has been removed;

initiating video and audio recording if the pull-pin-style safety mechanism has been removed;

querying whether the firearm has been fired; and notifying emergency services if the firearm has been fired.

2. The single-use firearm capable of firing a projectile, as recited in claim 1, further comprising:

a safety aperture extending through a trigger mechanism and a firing pin containment mechanism; and said removeable pull-pin-style safety mechanism, wherein said removeable pull-pin-style safety mechanism includes a bar that locks the firing pin containment mechanism when said bar extends through said safety aperture in said trigger mechanism and said firing pin containment mechanism.

3. The single-use firearm capable of firing a projectile, as recited in claim 2, further comprising:

an electronic contact trigger capable of sending an electronic signal to said control module of said internal circuitry once said removeable pull-pin-style safety mechanism is removed from said safety aperture.

4. A method for personal defense implementing a single-use firearm capable of firing a projectile, comprising the steps of:

providing a firearm frame;

providing at least a first barrel;

providing a trigger operable to actuate a striking of at least a first ammunition cartridge;

providing an ammunition locking system, wherein said ammunition locking system permanently locks said at least first ammunition cartridge within said firearm, whereby once locked, said at least a first ammunition cartridge may not be removed or reloaded without permanently damaging said firearm; and providing an electronic system configured within said firearm frame having at least a communication module, a geolocation module, at least one camera with microphone, a control module of an internal circuitry with a processor, a battery, a means for disabling said firearm, and a memory with a program stored thereon that, when executed by said processor of said control module performs the steps of:

booting up an electronic system within the firearm;

querying the status of the firearm;

querying if the firearm is in its base station;

querying the status of a primary battery of the firearm;

querying the status of a secondary battery of the firearm;

querying the status of a wireless local area network (WLAN) connection;

querying the status of a a short-range wireless communication protocol connection;

querying the status of a cellular connection;

querying the status of a Global Positioning System module and current Global Positioning System location;

querying whether the firearm is within a pre-defined geofence location;

disabling the firearm if the firearm is not within a predefined geofence location and reporting an overall status of the electronic system to a server;

reporting an overall status of the electronic system to a server if the firearm is within a predefined geofence location;

detecting whether the firearm is removed from its base station;

sending a notification to a user's smart home alarm system if the firearm is removed from its base station;

sending a notification to a remote monitoring station if the firearm is removed from its base station;

querying whether the firearm is within a pre-defined geofence location;

disabling the firearm if the firearm is not within a predefined geofence location and reporting an overall status of the electronic system to a server;

querying whether a pull-pin-style safety mechanism has been removed;

notifying emergency services if the pull-pin-style safety mechanism has been removed;

initiating video and audio recording if the pull-pin-style safety mechanism has been removed;

querying whether the firearm has been fired; and notifying emergency services if the firearm has been fired.

* * * * *